US010843773B2

(12) United States Patent
Mott

(10) Patent No.: US 10,843,773 B2
(45) Date of Patent: Nov. 24, 2020

(54) TUBE STOW

(71) Applicant: John C Mott, Iowa City, IA (US)

(72) Inventor: John C Mott, Iowa City, IA (US)

( * ) Notice: Subject to any disclaimer, the term of this patent is extended or adjusted under 35 U.S.C. 154(b) by 139 days.

(21) Appl. No.: 15/851,976

(22) Filed: Dec. 22, 2017

(65) Prior Publication Data

US 2018/0312226 A1 Nov. 1, 2018

Related U.S. Application Data

(60) Provisional application No. 62/438,293, filed on Dec. 22, 2016.

(51) Int. Cl.

| | |
|---|---|
| ***B63B 23/30*** | (2006.01) |
| ***B63B 27/16*** | (2006.01) |
| ***B63B 23/40*** | (2006.01) |
| ***B63B 23/32*** | (2006.01) |

(52) U.S. Cl.

CPC ..... *B63B 23/30* (2013.01); *B63B 23/32* (2013.01); *B63B 23/40* (2013.01); *B63B 27/16* (2013.01)

(58) Field of Classification Search

CPC ..... B63B 23/30; B63B 23/32; B63B 23/38; B63B 23/40; B63B 27/14; B63B 2027/141; B63B 27/143; B63B 27/146; B63B 2027/148; B63B 27/16; B63B 2027/165

See application file for complete search history.

(56) References Cited

U.S. PATENT DOCUMENTS 4,864,951 A * 9/1989 Koepp, Jr. ..... B63B 23/32 114/44
5,133,275 A * 7/1992 Maurizio ..... B63B 23/32 114/259
8,137,028 B2 * 3/2012 Wrobbel ..... B63C 3/00 114/366

FOREIGN PATENT DOCUMENTS

DE 29711945 U1 * 9/1997 ..... B63B 23/32
GB 2319014 A * 5/1998 ..... B63B 23/32

* cited by examiner

*Primary Examiner* — Ajay Vasudeva
(74) *Attorney, Agent, or Firm* — Simmons Perrine Moyer Bergman PLC

(57) ABSTRACT

A system and method of extracting a tube from the water by pulling the tube up a pair of elongated rails extending aft of the stern of a vessel and positioning the tube between a tube containment arm disposed above each of the elongated rails so that the tube is pressure fit therein. The pair of elongated rails can be pivoted up and out of the water for transportation and storage. The elongated rails and the tube containment arms can be telescopic.

5 Claims, 10 Drawing Sheets

TUBE STOW

CROSS REFERENCE TO RELATED APPLICATIONS

This application claims the benefit of a provisional application filed on Dec. 22, 2016, and having Ser. No. 62/438,293 entitled "TUBE STOW" which is hereby incorporated herein in its entirety by this reference.

FIELD OF THE INVENTION

The present invention generally relates to recreational boating, and more particularly relates to towed recreational inflatables (a.k.a. tubes), and, even more particularly, relates to a system and method for on-boat storage of towed recreational inflatables.

BACKGROUND OF THE INVENTION

In recent years, towed recreational inflatables have become increasingly popular, especially among people who are not skilled in or otherwise able to engage in water skiing, wake boarding and wake surfing. The typical size of these recreational inflatables has concurrently grown over the years from the classic automobile inner tube to very large multi-person inflatables, many with individual seats/riding locations and hand holds. Additionally, pontoon boats are widely popular as tow boats for towed recreational inflatables. Many times a pontoon boat filled with people will stop a pleasure cruise to go tubing. However, when the towed people are finished being towed, the other passengers are often eager to resume normal cruising speeds and paths.

In the past, boaters have stored the tube inside the boat or people have tried tying the tube on top of a Bimini cover over the boat. While these methods have enjoyed much use in the past, they have some drawbacks. The tube when stored in the boat, especially the very large tubes, can interfere with normal movement of the passengers in the boat. Also, these large tubes can be difficult to lift and then secure to the Bimini top. Often, this is a task best done by multiple strong and skilled adults. This makes it more difficult for certain cruising and tubing outings, such as elderly people taking young children tubing. Additionally, the elevated tube is prone to catching wind, which can decrease the maximum speed of the boat and can increase fuel consumption.

Consequently, there exists a need for improved methods and systems for launching, extracting and storing large recreational inflatables on a boat.

SUMMARY OF THE INVENTION

It is an object of one aspect of the present invention to increase the ease of extraction of a large tube from the water.

It is a feature of one aspect of the present invention to utilize a plurality of inclined rails extending aft of the stern of the vessel.

It is an advantage of the present invention to provide for a capability of easily guiding the tube out of the water.

It is additional feature of the present invention to provide a plurality of containment arms for restricting movement of the tube away from the inclined rails.

It is an additional advantage of this embodiment of the present invention to provide a simple slide in compression fit tube containment and storage option.

Accordingly, the present invention is:

A method of extracting a recreational inflatable device from a body of water comprising the steps of:

- providing, in a parallel configuration, a plurality of extraction rails each with an extraction rail submersible end;
- providing a tube containment arm disposed on each of said plurality of extraction rails;
- mounting each of said plurality of extraction rails to a boat; and
- pulling a recreational inflatable device so as to be simultaneously disposed on each of said plurality of extraction rails and underneath each of said tube containment arm disposed on each of said plurality of extraction rails.

Additionally, the present invention is system including a tube extraction and storage system comprising:

- a first telescopic extraction rail 10 which includes a first telescopic extraction rail inner tube 12 and a first telescopic extraction rail outer tube 15 and a first telescopic extraction rail length adjustment lock;
- a first tube containment arm 40 coupled to said first telescopic extraction rail 10 in a manner which provides for pressure fit containment of a recreational inflatable devices therebetween;
- said first tube containment arm 40 is spaced apart but running parallel to said first telescopic extraction rail 10;
- a first mount configured for coupling said first telescopic extraction rail 10 to a tow bar on a vessel;
- a second telescopic extraction rail 10 which includes a second telescopic extraction rail inner tube 12 and a second telescopic extraction rail outer tube 15 and a second telescopic extraction rail length adjustment lock;
- a second tube containment arm 40 adjustably coupled to said second telescopic extraction rail 10 in a manner which provides for pressure fit containment of a recreational inflatable devices therebetween;
- said second tube containment arm 40 is spaced apart but running parallel to said second telescopic extraction rail 10; and
- a second mount configured for coupling said second telescopic extraction rail 10 to a tow bar on a vessel.

DETAILED DESCRIPTION

Figure 1:
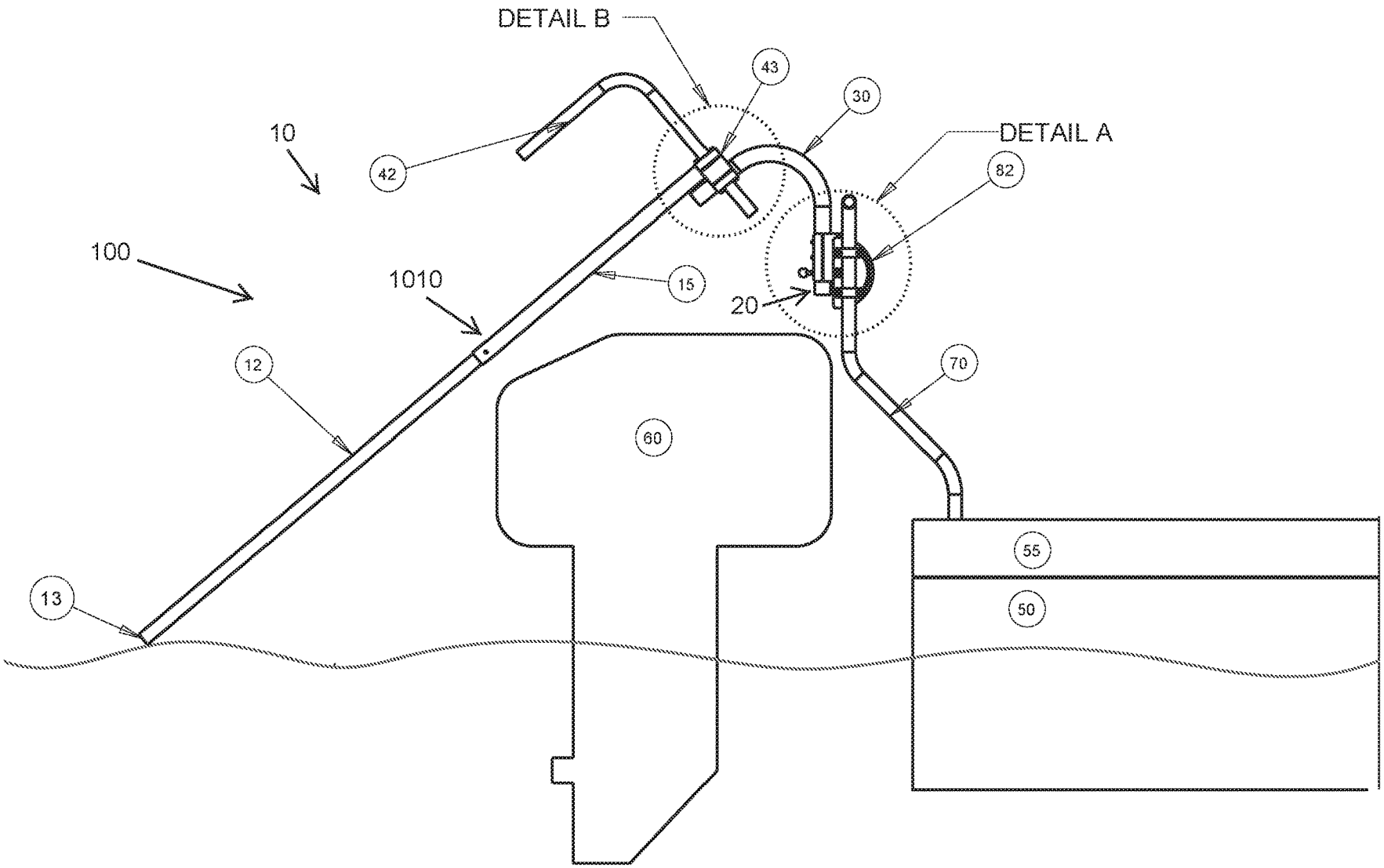
FIG. 1 is an elevation view of portions of tube extraction and storage systems of the present invention, shown in its intended environment, in a deployed configuration.

Now referring to the drawings wherein like numerals refer to like matter throughout there are shown representations of an embodiment of the present invention in its intended environment, which in one embodiment includes a system of the tube extraction and storage system 100 which is disposed on a boat which includes pontoon 50, deck 55 and a tow rope bar 70. Tube extraction and storage system 100 includes a telescopic extraction rail 10, with telescopic extraction rail inner tube 12 and telescopic extraction rail outer tube 15. Telescopic extraction rail inner tube 12 includes a telescopic extraction rail inner tube submersible end 13 and telescopic extraction rail inner tube non-submersible end 14. Telescopic extraction rail outer tube 15 includes telescopic extraction rail outer tube adjustment pin end 16. Telescopic extraction rail inner tube 12 and telescopic extraction rail outer tube 15 have an adjustable length characteristic by nature of telescopic extraction rail adjustment pin 1010 and a plurality of holes in telescopic extraction rail inner tube 12.

Telescopic extraction rail 10 is coupled to tow rope bar 70 through a series of components including multi-member clamp 43, non-continuously curved intermediate member 30, and main support angular orientation adjusting system 80.

Non-continuously curved intermediate member 30 has a non-continuously curved intermediate member tube end 32 and a non-continuously curved intermediate member boat end segment 20. Non-continuously curved intermediate member 30 is coupled to telescopic extraction rail 10 via multi-member clamp 43 which also couples tube containment arm 40 in a length adjustable manner via tube containment arm spring loaded height adjustment pin 45. Tube containment arm 40 includes tube containment arm tube contacting end 42 and tube containment arm tube non-contacting end 44.

Non-continuously curved intermediate member boat end segment 20 is coupled to main support bar clamp 84 which is a portion of main support angular orientation adjusting system 80. Main support bar clamp 84 is configured to pivot around main support angular orientation adjusting threaded locking handle 88 which extends through a hole through main support angular orientation adjusting plate 82. The angular orientation of non-continuously curved intermediate member boat end segment 20 is selectable by use of main support angular orientation adjusting plate engaging spring loaded pin 86 which extends through main support bar clamp 84 and into one of the predetermined main support angular orientation adjusting plate holes 83.

Figure 2:
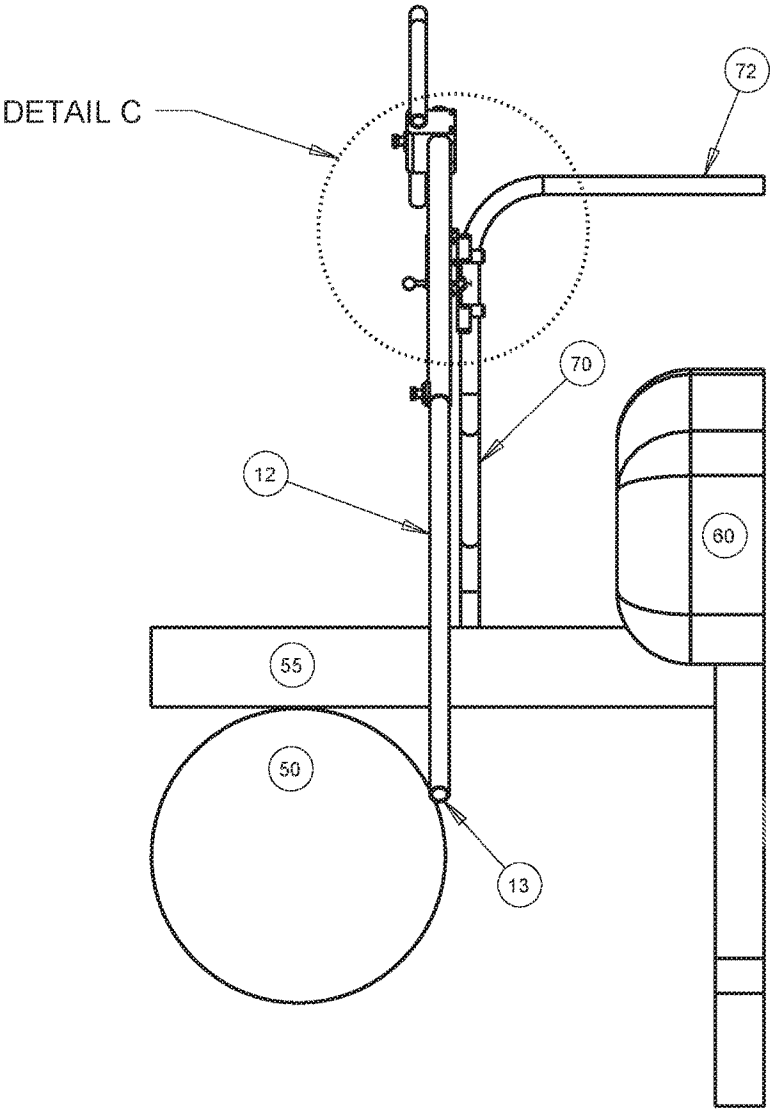
FIG. 2 is an orthogonal view of the system of FIG. 1.
Figure 3:
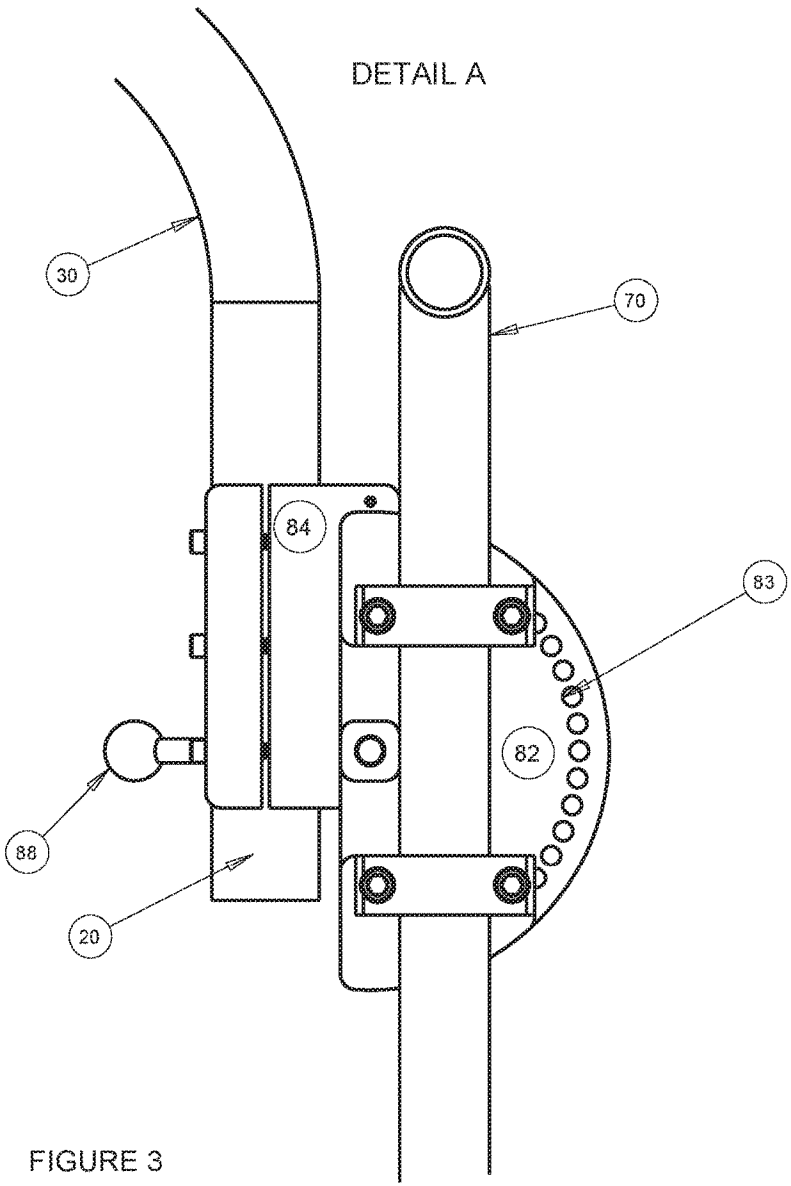
FIG. 3 is a detailed close up view of a portion of FIG. 1.
Figure 4:
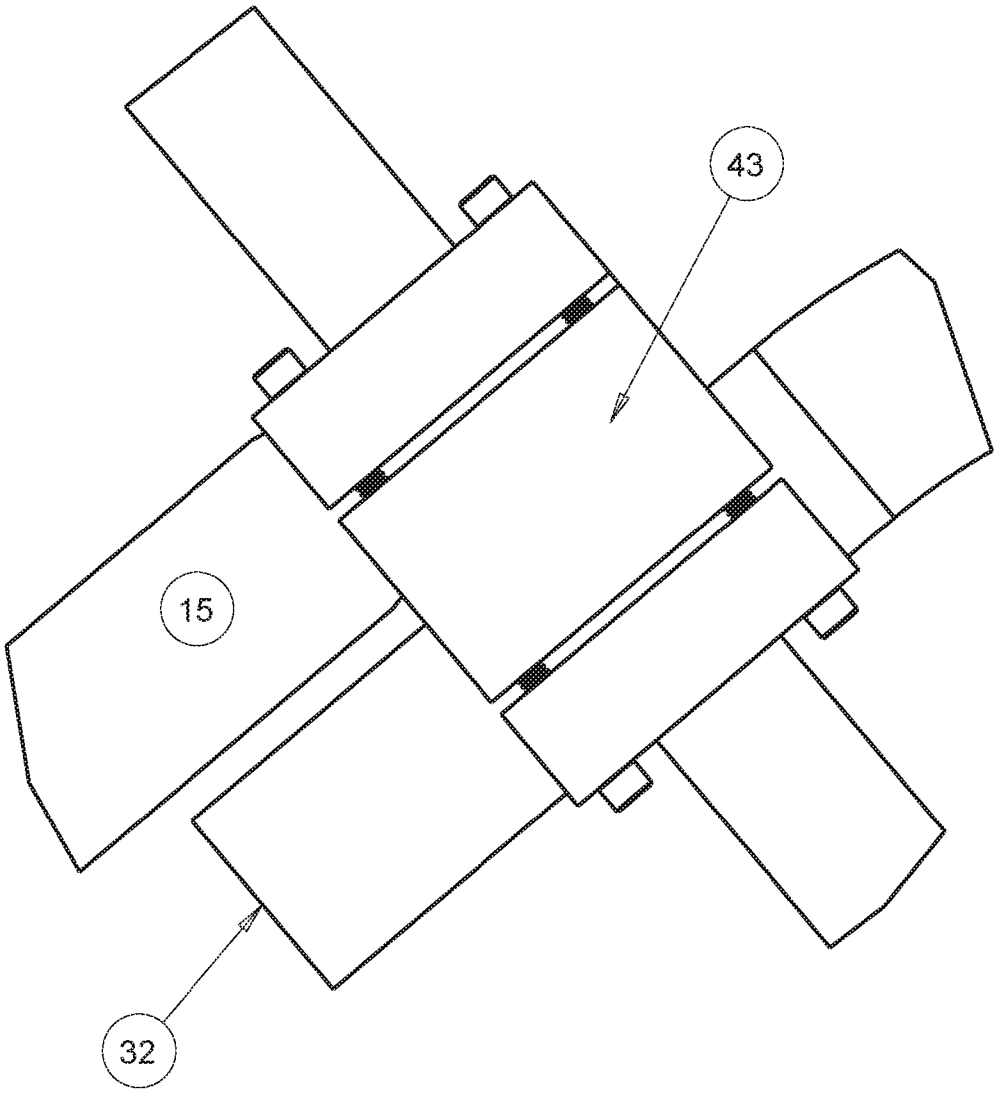
FIG. 4 is a detailed close up view of portions of FIG. 1.
Figure 5:
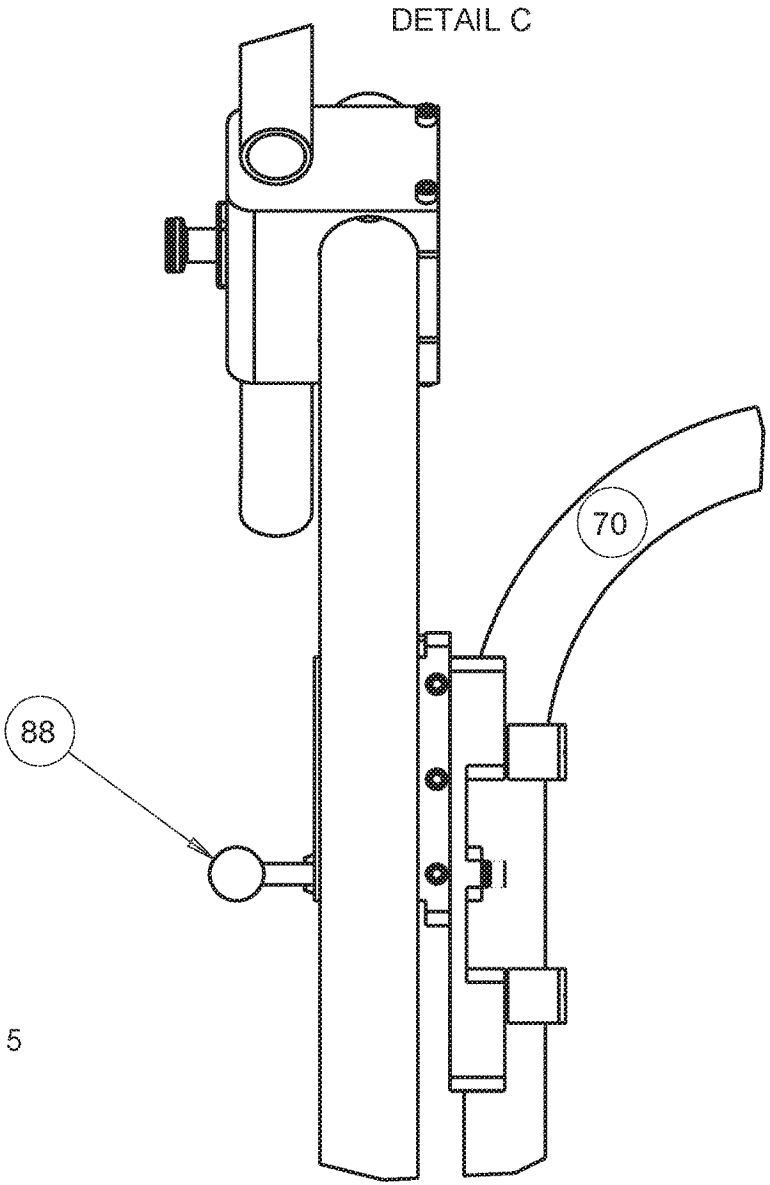
FIG. 5 is a detailed close up view of a portion of FIG. 2.

Now referring specifically to FIG. 2, it can be seen that the tube extraction and storage system 100 of the present invention is located on the left side of the outboard motor 60. It should be understood that a similar or mirror imaged system would preferably be located on the right side of the motor 60 as well, so that two telescopic extraction rails 10 would extend aft of the stern of the vessel. In some situations, it might be desirable to adjust the angle of main support angular orientation adjusting system 80 differently for the two different tube extraction and storage systems 100. This could create more tube retention pressure and assist in rapid securement of the tube in windy conditions, especially cross winds.

The beneficial aspects of the present invention are most easily understood by discussing its operation. It is assumed that two mirror image tube extraction and storage systems 100 are located on opposite sides of a tow rope bar 70. Each of the telescopic extraction rails 10 is telescoped so that telescopic extraction rail inner tube submersible end 13 is located right at the water level. The tube can be launched by sliding it down the rails (after the tow rope has been connected at one end to the tube and the other end to the tow rope bar 70). If desired each of the main support angular orientation adjusting systems 80 can be adjusted to slightly lift telescopic extraction rail inner tube submersible end 13 so that they do not contact the water during turns. This adjustment is accomplished as follows: main support angular orientation adjusting threaded locking handle 88 is turned so as to release pressure between main support bar clamp 84 and main support angular orientation adjusting plate 82, main support angular orientation adjusting plate engaging spring loaded pin 86 is pulled out to a point of disengagement with main support angular orientation adjusting plate 82. The non-continuously curved intermediate member 30 is rotated around main support angular orientation adjusting threaded locking handle 88 and the main support angular orientation adjusting plate engaging spring loaded pin 86 is allowed to re-enter the desired one of the main support angular orientation adjusting plate holes 83. The main support angular orientation adjusting threaded locking handle 88 can be tightened as desired. When it is time to remove the tube from the water, the main support angular orientation adjusting systems 80 can be adjusted downward or the tube front may be lifted slightly to get it on top of the telescopic extraction rails 10. The tube is then pulled up the rails and tied tight to the tow rope bar 70. If desired, one or both of the main support angular orientation adjusting systems 80 can be adjusted.

Figure 6:
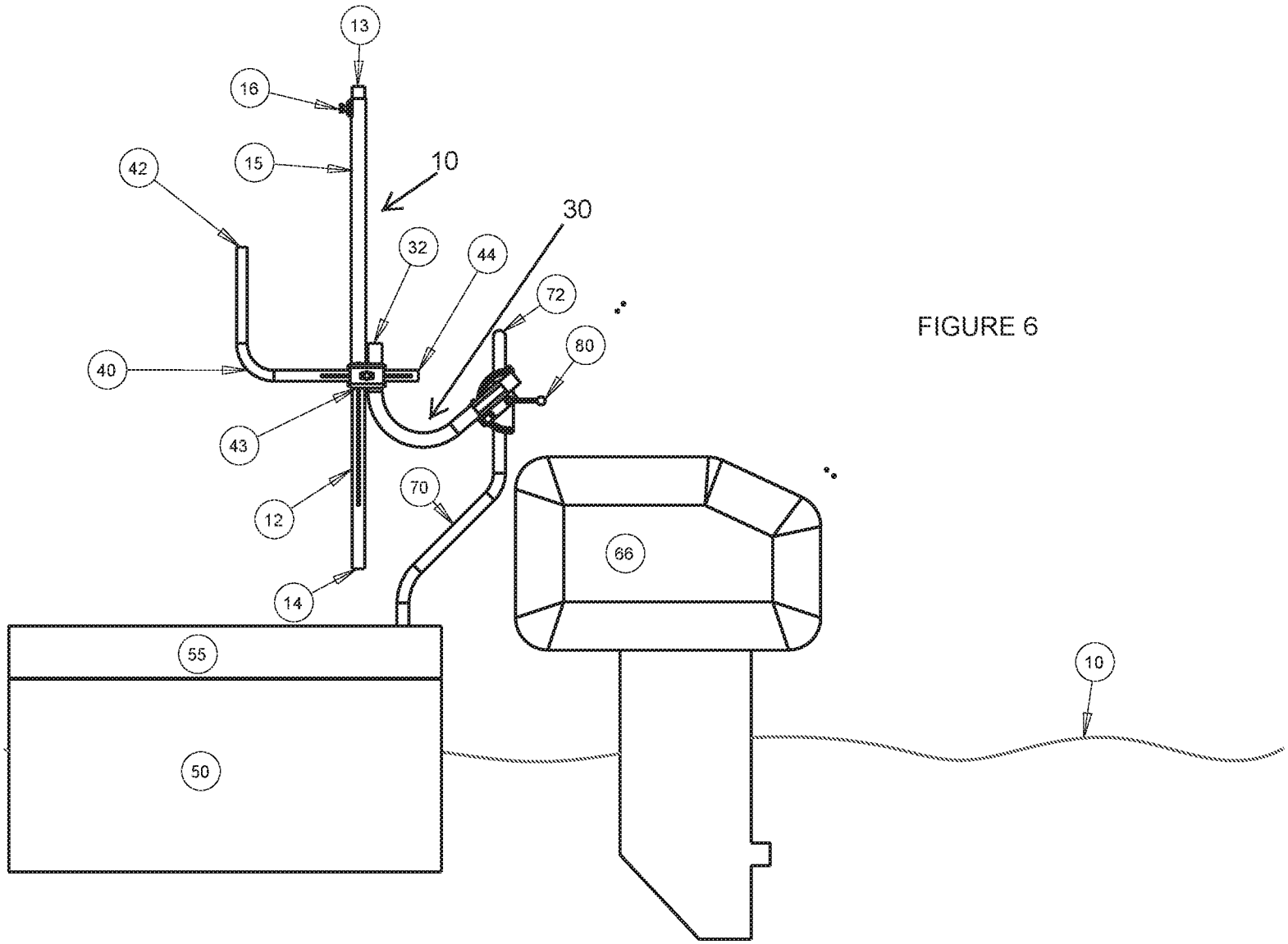
FIG. 6 is a view of a portion of the system of FIG. 1 in a first representative storage configuration, which is taken from an opposing side from FIG. 1 and orthogonal to FIG. 2.
Figure 7:
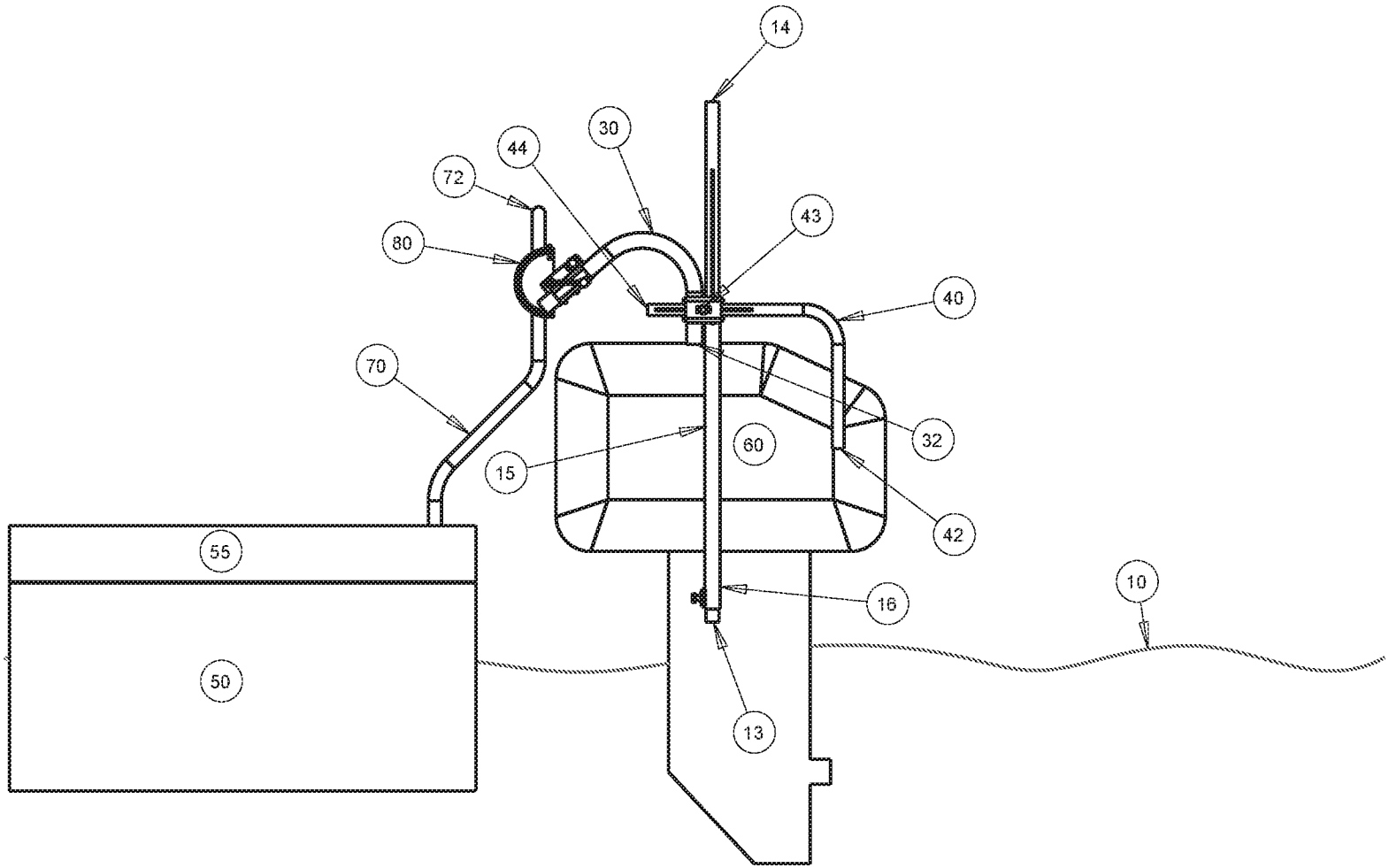
FIG. 7 is a view of a portion of the system of FIG. 1 in a second representative storage configuration, which is taken from an opposing side from FIG. 1 and orthogonal to FIG. 2.
Figure 8:
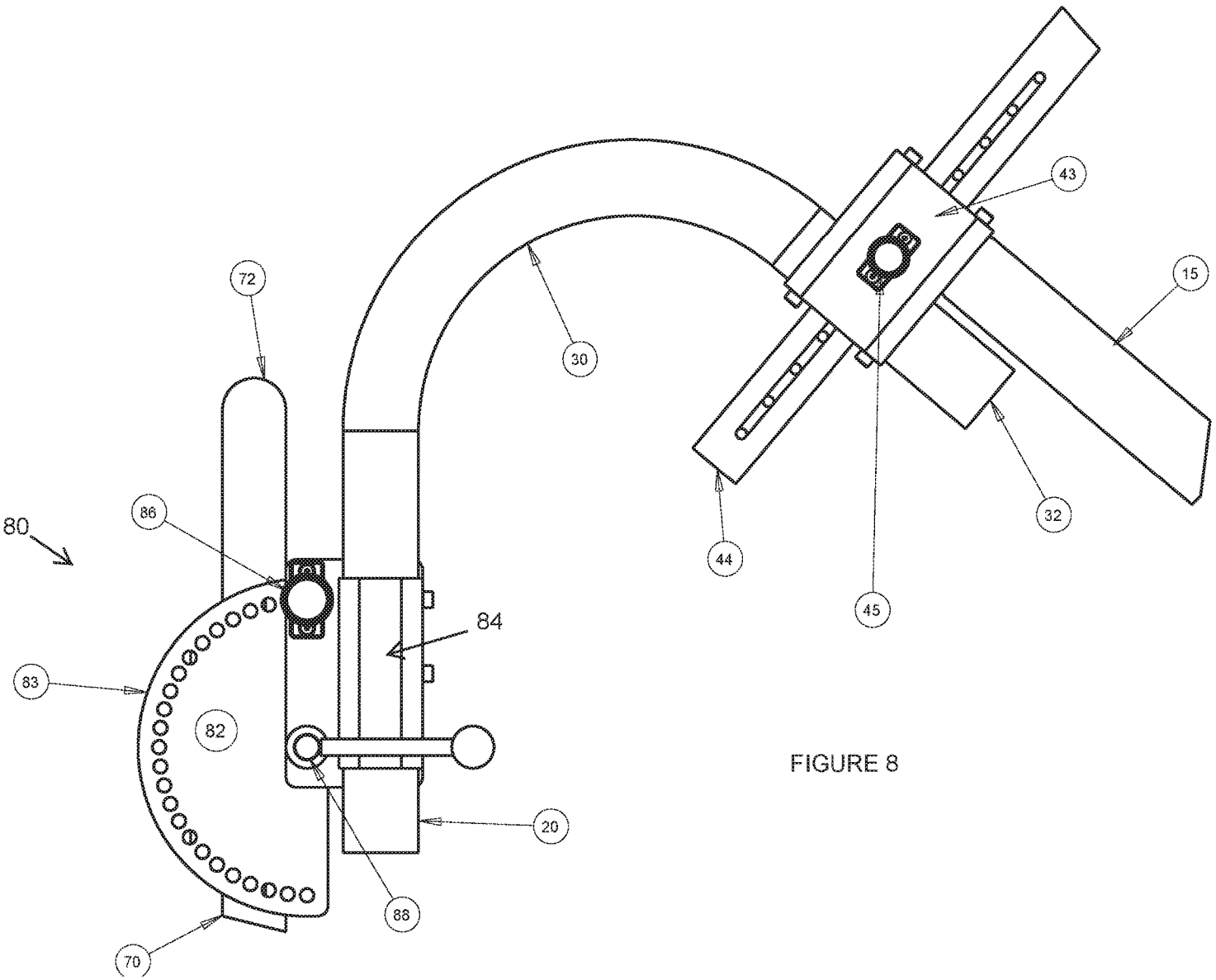
FIG. 8 is a close up view of portions of the present invention in the deployed configuration of FIG. 1 which is taken from the same side as FIGS. 6 and 7.
Figure 9:
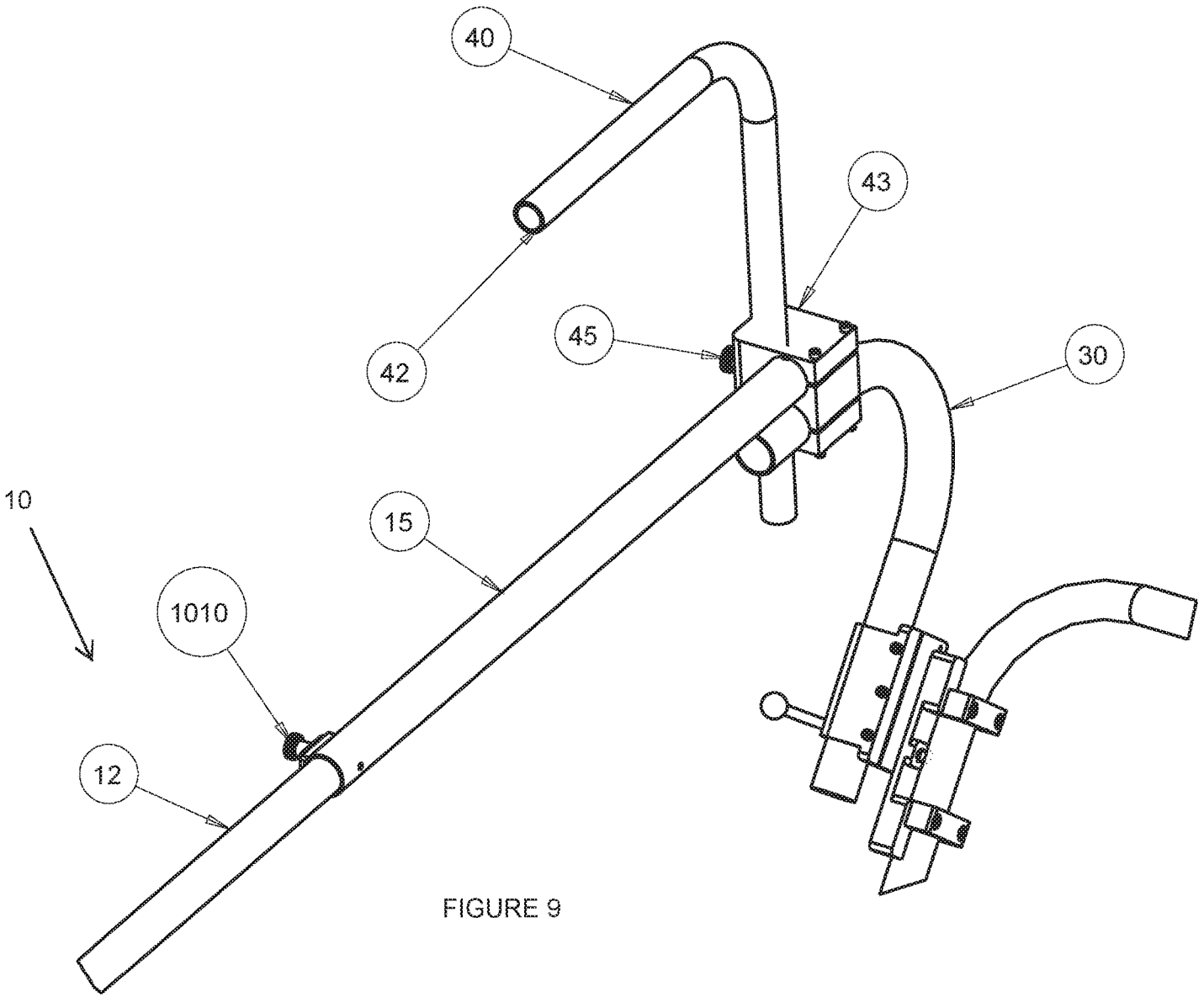
FIG. 9 is a close up view of portions of the present invention shown from a different perspective from FIGS. 1, 2 and 8.
Figure 10:
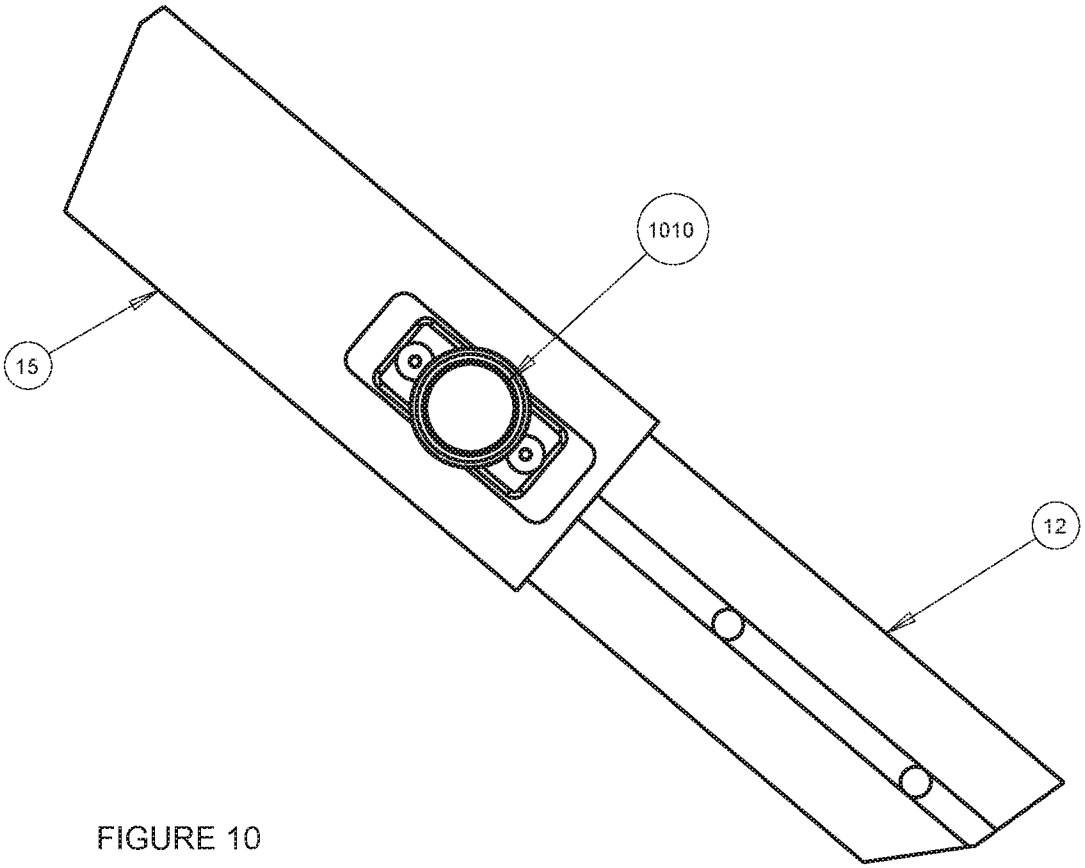
FIG. 10 is another close up perspective view of a portion of the present invention from a different perspective from FIGS. 1, 2, 6, 8 and 9.

Now referring to FIGS. 6 and 7, there are shown two possible storage positions of the present invention. Various adjustments of telescopic extraction rail adjustment pin 1010, main support angular orientation adjusting plate engaging spring loaded pin 86 and main support angular orientation adjusting threaded locking handle 88 can be made which can result in a variety of orientations which may be optimal, depending upon the particular storage situation.

Telescopic extraction rail 10 may be preferred as shown however other variations are contemplated such as: it can be one piece, multi pieces, telescoping, adjustable length, adjustable height, hinged, removable, permanent, semi-permanent, any shape, have rollers on it, swing/move, ridged or flexible. There can be multiple main support bars. Bungee cord or rope can be attached to each bar to help support tube. There can be cross pieces that run from one main support bar to the other. These can be permanent or temporary. Also they can be constructed so tube sits below ski tow bar so a person can ski when tube is in the Tube Stow.

The telescopic extraction rail 10 could be preferably mounted to the boat as shown, however other variations could be utilized as well, such as the rail mounts or anchors could be permanent, semi-permanent or temporary. They could be added onto an existing boat, existing boat hardware or built into boat or boat hardware (like ski bar), removable, adjustable height, adjustable width, hinged, any shape, swing in and out, telescoping, one or more pieces.

The telescopic extraction rail 10 could be a solid angle, adjustable angle, adjustable height, adjustable width, hinged, swing/move, lock in one position, and or telescope.

Tube containment arm 40 could be solid or multiple pieces, adjustable height or length or width, hinged, removable, permanent, semi-permanent, swing/move, telescope up or down or out or sideways, multi-tiered, springy, ridged, and/or forked.

While throughout this discussion a pontoon boat has been proposed as a means for pulling the tube, it should be understood that other types of water craft could be used.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. A tube extraction and storage system comprising:

a first telescopic extraction rail which includes a first telescopic extraction rail inner tube and a first telescopic extraction rail outer tube and a first telescopic extraction rail length adjustment lock;

a first tube containment arm coupled to said first telescopic extraction rail in a manner which provides for pressure fit containment of a recreational inflatable devices therebetween;

said first tube containment arm is spaced apart but running parallel to said first telescopic extraction rail;

a first mount configured for coupling said first telescopic extraction rail to a tow bar on a vessel;

a second telescopic extraction rail which includes a second telescopic extraction rail inner tube and a second telescopic extraction rail outer tube and a second telescopic extraction rail length adjustment lock;

a second tube containment arm adjustably coupled to said second telescopic extraction rail in a manner which provides for pressure fit containment of a recreational inflatable devices therebetween;

said second tube containment arm is spaced apart but running parallel to said second telescopic extraction rail; and a second mount configured for coupling said second telescopic extraction rail to the tow bar on the vessel.

2. The tube extraction and storage system of claim 1 wherein said first tube containment arm has an adjustable separation distance from said first telescopic extraction rail.

3. The tube extraction and storage system of claim 1 wherein said first tube containment arm is removable.

4. The tube extraction and storage system of claim 1 wherein said first tube containment arm is rotatable.

5. The tube extraction and storage system of claim 1 wherein said first tube containment arm is flexible.

* * * * *